United States Patent [19]

Cheng-Chung

[11] Patent Number: 4,891,855

[45] Date of Patent: Jan. 9, 1990

[54] INFLATABLE SUNTANNER WITH SPEEDY AND HOMOGENEOUS SUNTAN EFFECT

[75] Inventor: Wang Cheng-Chung, Taipei, Taiwan

[73] Assignee: Team Worldwide Corporation, Taipei, Taiwan

[21] Appl. No.: 270,786

[22] Filed: Nov. 14, 1988

[51] Int. Cl.[4] ..... A47C 27/08

[52] U.S. Cl. ..... 5/449; 5/458

[58] Field of Search ..... 5/449, 455, 458, 421, 5/457, 451, 441; 297/DIG. 3; 128/376

[56] References Cited

U.S. PATENT DOCUMENTS

| | | | |
|---|---|---|---|
| 3,170,172 | 2/1965 | Kessman | 5/449 |
| 4,092,750 | 6/1978 | Ellis | 5/457 |

FOREIGN PATENT DOCUMENTS

| | | | |
|---|---|---|---|
| 2850021 | 9/1978 | Fed. Rep. of Germany | 5/455 |
| 563140 | 4/1974 | Switzerland | 5/449 |
| 611144 | 4/1976 | Switzerland | 5/455 |

*Primary Examiner*—Gary L. Smith
*Assistant Examiner*—F. Suether
*Attorney, Agent, or Firm*—Silverman, Cass & Singer, Ltd.

[57] ABSTRACT

An inflatable suntanner comprising an upper transparent layer, a middle reflective layer and a bottom layer which are all made of flexible, gas impervious material. The middle layer is bonded to the upper layer at a plurality of upper joints and to the bottom layer at a plurality of lower joints, with the area or size of each upper joint being different from that of each lower joint so as to corrugate those portions of the middle reflective layer interconnecting the upper and lower joints. Accordingly, sunlight passing through the upper transparent layer and incident on the corrugated reflective layer is both evenly and irregularly reflected upon the side not exposed to the sun rays, of a user on the suntainner so as to expedite a homogeneous suntan.

5 Claims, 7 Drawing Sheets

Fig.1 (PR10R ART)

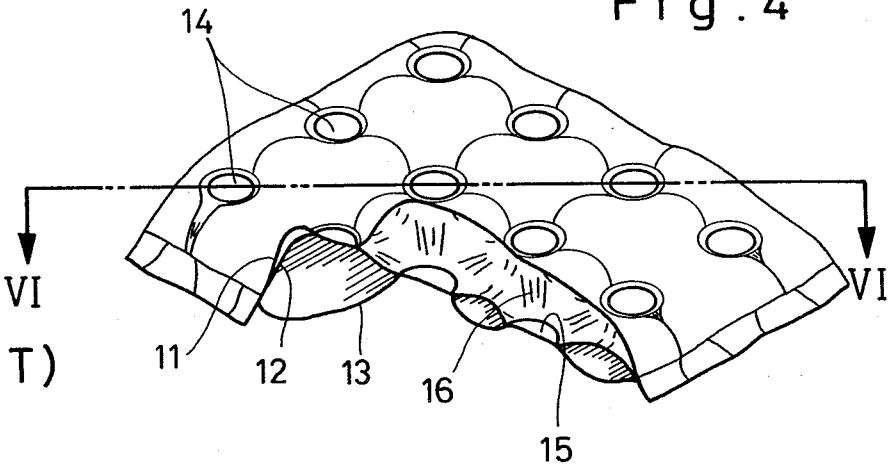
Fig. 4
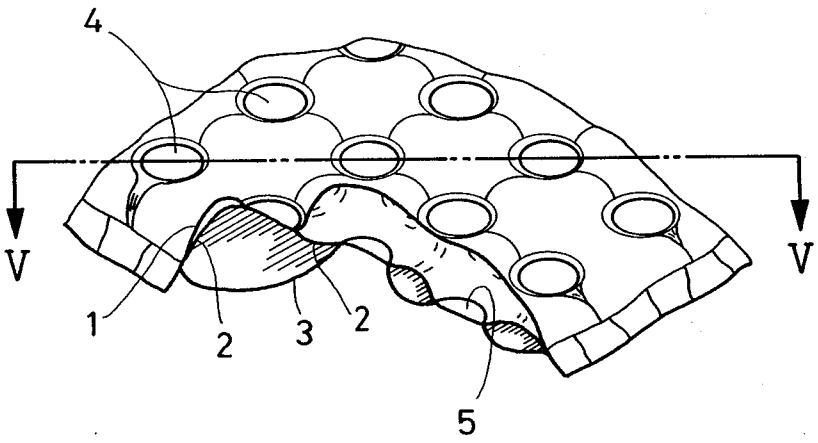
Fig. 3(PR10R ART)

Fig. 5(PR10R ART)

Fig. 9
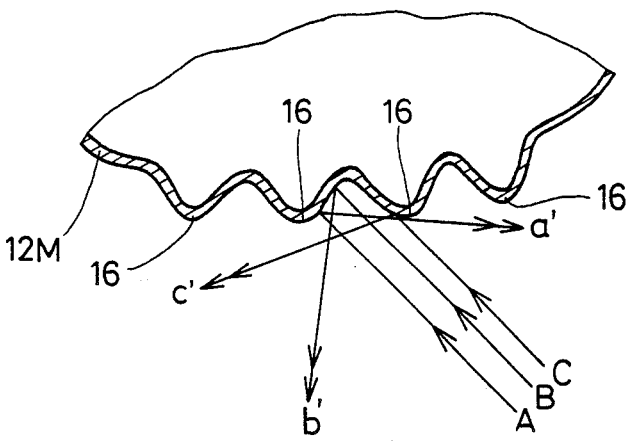
Fig. 10 (PR10R ART)
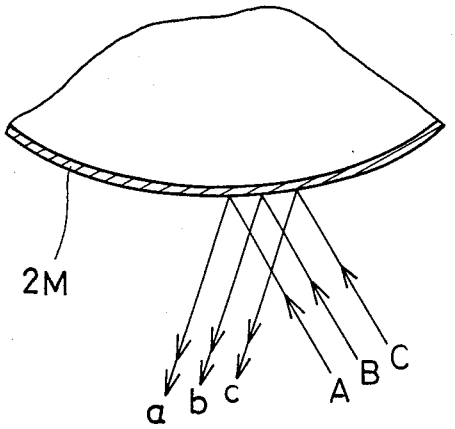

INFLATABLE SUNTANNER WITH SPEEDY AND HOMOGENEOUS SUNTAN EFFECT

FIELD OF THE INVENTION

This invention relates to an inflatable suntanner which comprises three layers of flexible, gas impervious materials and can be used to obtain an homogeneous suntan.

BACKGROUND OF THE INVENTION

In the past, inflatable suntanners usually comprised only an upper and a lower layer, both made of opaque materials and bonded together by, for instance, heat sealing means along the peripheries thereof and also at a plurality of joint portions within the area bounded by their peripheries. When using this type of suntanner, only the skin of the exposed side of the user would receive the sun rays. The side of the user not exposed had no chance to receive the sunlight unless the user turned over his or her body. Consequently, a speedy and homogeneous suntan could not be achieved by the use of this type of conventional inflatable suntanner.

In order to improve the defect of the above-described two-layered inflatable suntanner, it was proposed to add another transparent layer over the two opaque layers, so as to form a three-layered inflatable suntanner comprising an upper transparent layer, a middle reflective layer and a bottom layer. When using this type of suntanner, the body of the user is raised above the reflective layer by the upper transparent layer, and sunlight passing through the transparent layer and incident on the reflective layer is partially reflected to the side of the user not exposed, so that the latter can simultaneously receive some reflected sunlight when one side of the user receives the sun rays, whereby expediting the suntan. However, since the surface of the reflective layer is generally smooth, the varied components of the incident sunlight are, respectively, reflected along substantially parallel directions. Since the substantially parallel reflected sunlight does not permit the side of the user not exposed to receive an even suntan, an ideal suntan cannot be achieved by the use of this type of three-layered inflatable suntanner.

SUMMARY OF THE INVENTION

In view of the drawback of the afore-mentioned conventional three-layered inflatable suntanner, this invention intends to provide a novel inflatable suntanner by which the side of the user not exposed to the sun rays can receive reflected sunlight, so that a speedy and homogeneous suntan effect may be obtained.

According to this invention, the inflatable suntanner comprises an upper transparent layer, a middle reflective layer and a bottom layer. These layers are all made of flexible, gas impervious materials. The middle layer is respectively bonded to the upper and bottom layers at a plurality of upper joints and a plurality of lower joints, and the area or size of each upper joint is different from that of each lower joint so as to corrugate those portions of reflective layer interconnecting the upper and lower joint, whereby sunlight passing through the upper transparent layer and evident on the corrugated reflective layer is irregularly reflected into the side of the user not directly exposed to the sunrays, producing a rapid and homogeneous suntan on the latter.

BRIEF DESCRIPTION OF THE DRAWINGS

This invention will be more fully understood from the following detailed description, taken in connection with the accompanying drawings in which:

FIG. 3 is an enlarged perspective view of a portion of the inflatable suntanner shown in FIG. 1 with one corner of the suntanner being taken away so as to show the interior structure thereof;

FIG. 4 is an enlarged perspective view of a portion of the inflatable suntanner shown in FIG. 2 with one corner of the suntanner being taken away so as to show the interior structure thereof;

FIG. 9 is a fragmentary enlarged sectional view taken along an IX—IX line in FIG. 8, showing the condition of diffused reflection (irregular reflection) when sunlight incident upon the reflective layer is reflected by the corrugated surface of the latter; and FIG. 10 is a fragmentary sectional view, similar to FIG. 9, of the conventional inflatable suntanner shown in FIG. 1, illustrating substantially parallel reflection when sunlight incident upon the reflective layer is reflected by the smooth surface of the latter.

DETAILED DESCRIPTION OF THE EMBODIMENT

Figure 1:
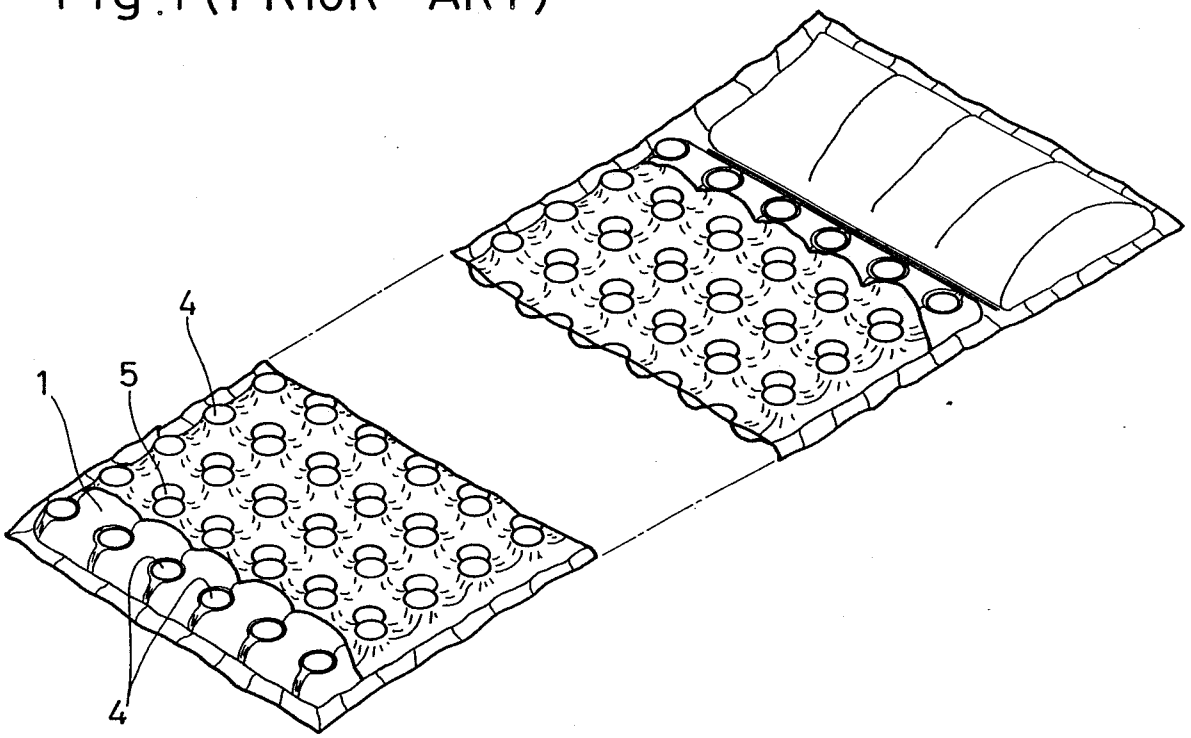
FIG. 1 is a perspective view of a conventional three layered inflatable suntanner in which the upper transparent layer is partially taken away so as to clearly show the appearance of the reflective layer.
Figure 5:
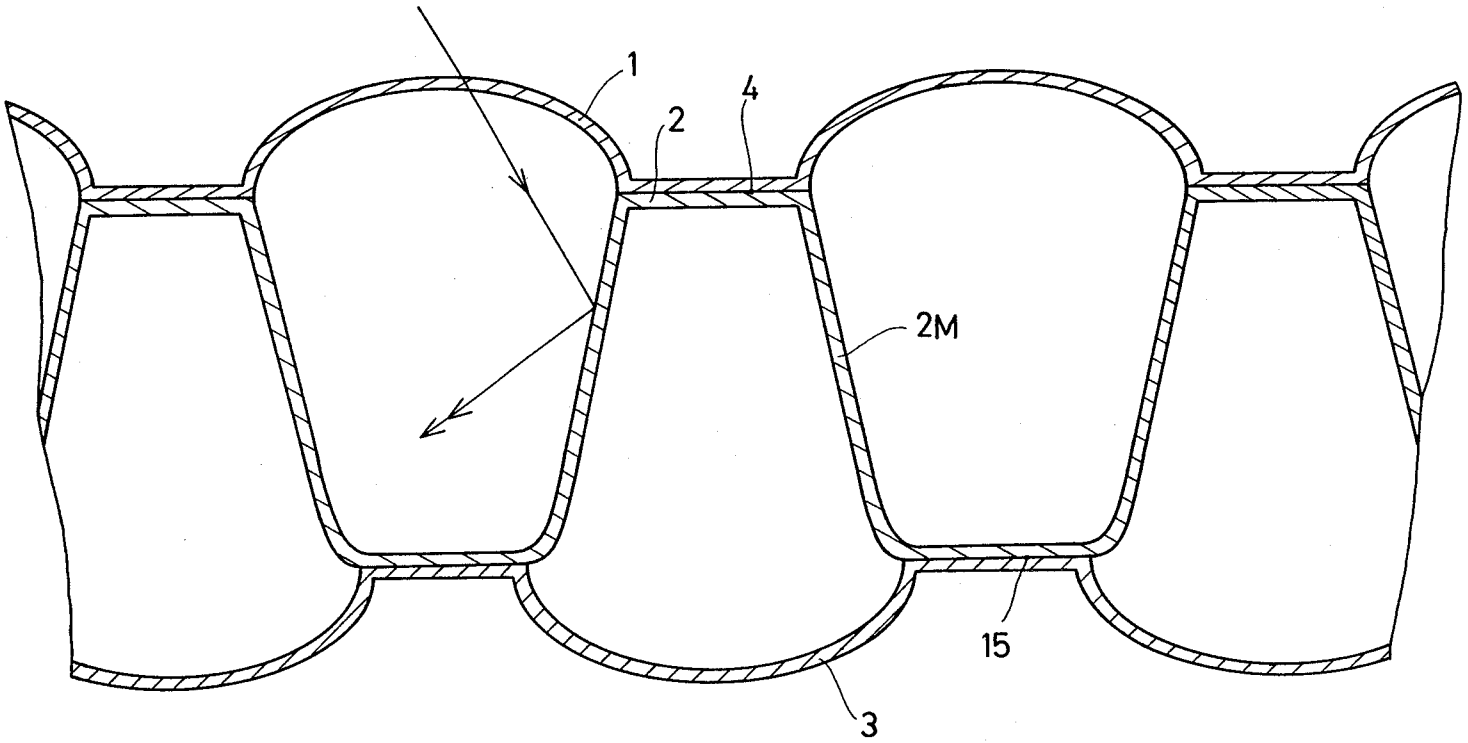
FIG. 5 is a sectional view taken along the V—V line in FIG. 3, showing the details of how the three layers of the conventional inflatable suntanner shown in FIGS. 1 and 3 are bonded together.

FIGS. 1, 3 and 5 show a conventional three-layered inflatable suntanner comprising an upper layer 1, a middle layer 2 and a bottom layer 3 each of which is made of flexible, gas impervious material. The upper layer 1 is formed of transparent material, while the middle and bottom layers 2 and 3 are formed of opaque material. The middle layer 2 acts as a reflective layer for reflecting, toward the skin on the shady side of the user laying on the suntanner, the part of sunlight passing through the upper transparent layer 1 and incident on the middle reflective layer 2. It can be seen from FIGS. 3 and 5 that the upper and middle layers 1 and 2 are bonded together at a plurality of upper joints 4, and that the middle and bottom layers 2 and 3 are bonded together at a plurality of lower joints 5. If the upper layer 1 is uncovered so as to observe the interior of the suntanner, it can be found that on the surface of the middle layer 2 there exists a plurality of mountain-shaped portions, each of which has an upper joint 4 on the peak thereof. Each lower joint 5 is located at a valley-like section surrounded by four mountain-shaped sections. Since the upper joint 4 and lower joint 5 are identical in their size, the slope portions 2M interconnecting the adjacent upper and lower joints 4 and 5 (see FIG. 5) have substantially smooth surface (see also FIG. 10). Consequently, parallel sunlight beams A, B and C incident onto the reflective layer 2 are reflected by the smooth surface of the slope portios 2M which result in generally parallel reflective sun beams a, b and c. Due to the fact that the reflected beams a, b and c are reflected in substantially parallel directions, some areas of the side of the user not exposed may receive relatively concentrated reflected beams, while the remaining areas may receive few reflected beams. Accordingly, it is impossible to achieve an ideal suntan effect.

Figure 2:
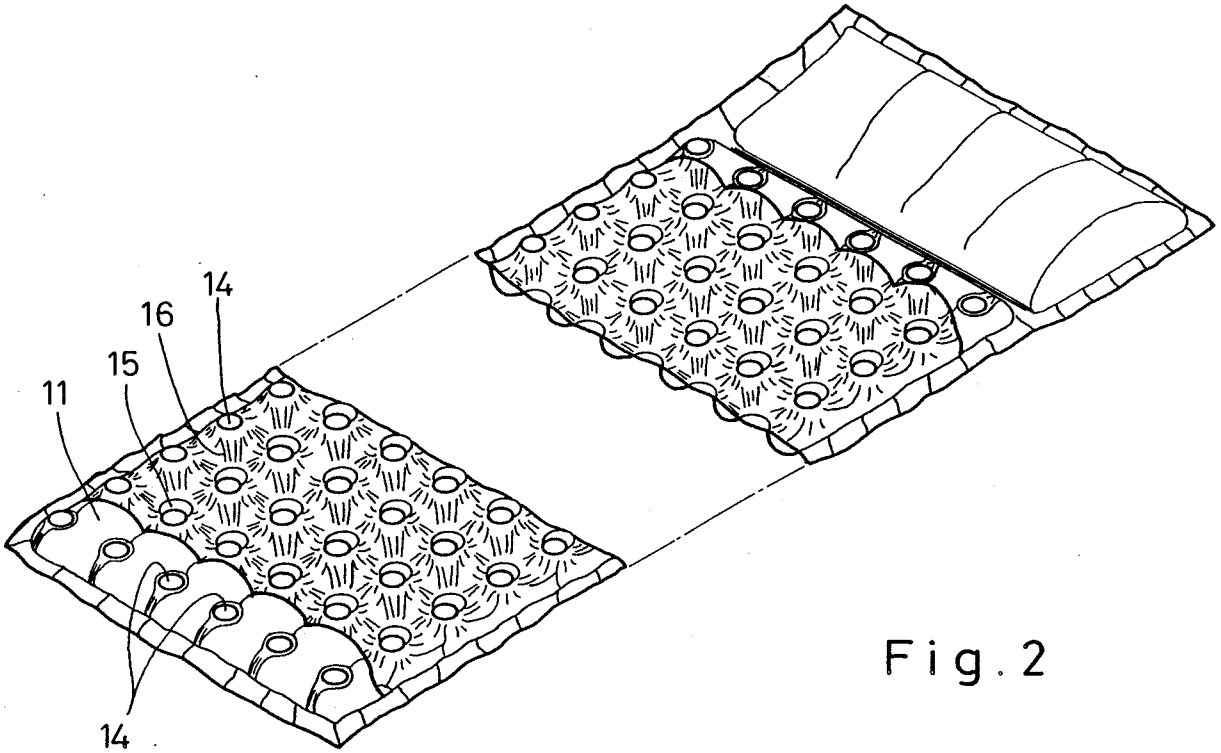
FIG. 2 is a perspective view of an inflatable suntanner in accordance with one embodiment of this invention, in which the upper transparent layer is partially removed so as to clearly show the appearance of the reflective layer.
Figure 6:
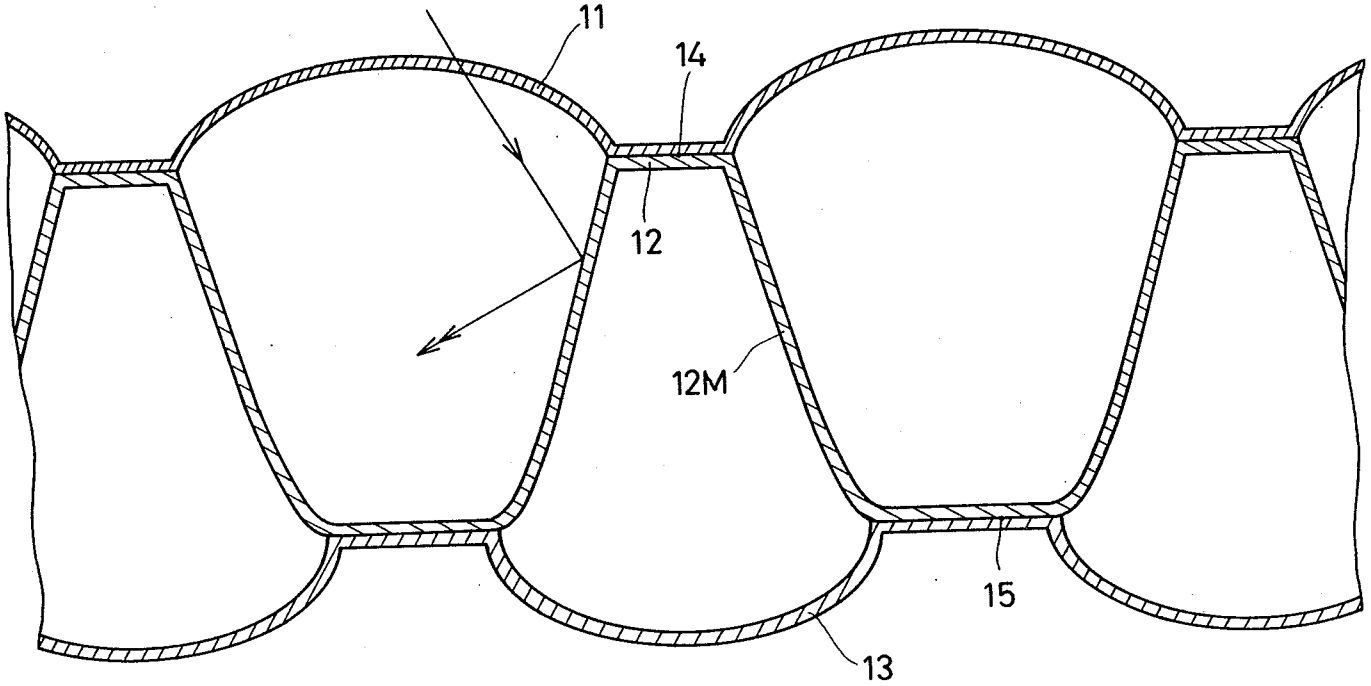
FIG. 6 is a sectional view taken along the VI—VI line in FIG. 4, showing the details of how the three layers of the inflatable suntanner according to this invention (see FIGS. 2 and 4) are bonded together.
Figure 7:
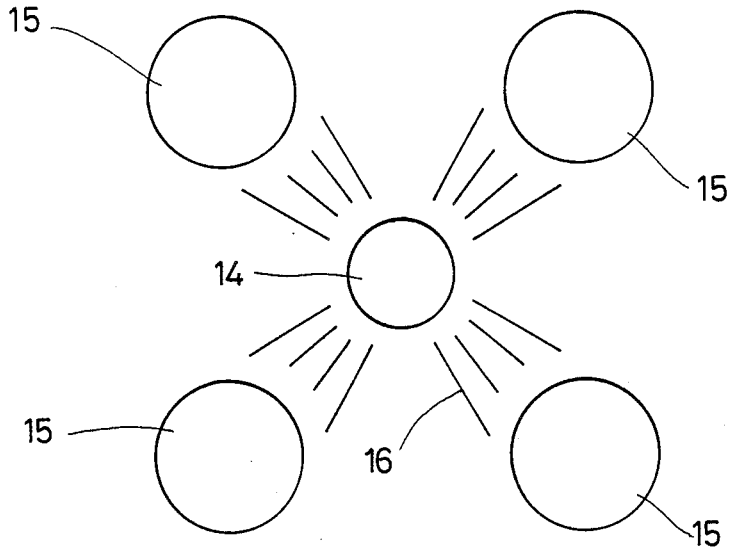
FIG. 7 is a fragmentary enlarged top view of the suntanner of FIG. 2, showing the size comparision between the upper joints bonding the upper and middle layers of the suntanner and the lower joints bonding the middle and bottom layers of the suntanner, and also showing the corrugated surfaces of the reflective layer interconnecting each pair of adjacent upper and lower joints.
Figure 8:
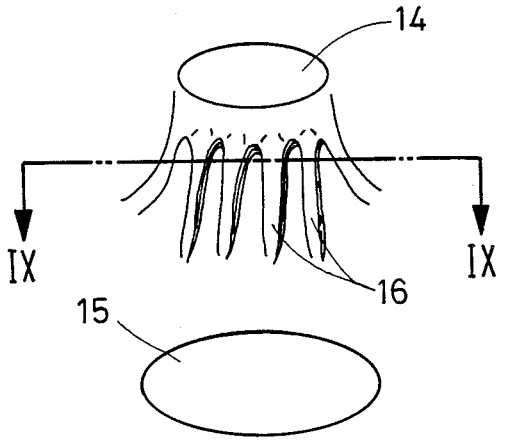
FIG. 8 is a perspective view of a pair of adjacent upper and lower joints in an inflatable suntanner according to this invention (see also FIG. 2)

In comparison, the construction of the inflatable suntanner in accordance with this invention is shown in FIGS. 2, 4 and 6. This inflatable suntanner also comprises an upper transparent layer 11, a middle reflective layer 12 and a bottom layer 13, all made of flexible, gas impervious materials. The middle layer 12 is bonded to the upper and bottom layers 11 and 13 in a manner similar to that of the above-described conventional three-layered inflatable suntanner so as to form an upper gas chamber between the upper layer 11 and the middle layer 12 and a lower gas chamber between the middle layer 12 and the bottom layer 13. The upper gas chamber communicates with the lower gas chamber. As compared with the conventional suntanner, a significant distinction resides in the difference in the sizes of the upper and lower joints 14 and 15. This size difference provides a larger effective engagement portion about the circumference of each of the larger diameter circles with respect to the engagement portion about the circumference of each of the smaller diameter circles. This results in, on the slopes 12M interconnecting the upper and lower joints 14 and 15, corrugated surfaces comprising a plurality of grooves 16 extending in generally parallel directions around each upper joint 14 because the comprising material of the reflective layer 12 necessarily gathers on the narrower side near the smaller joint, namely, the upper joint 14 in the illustrated case (see also FIGS. 6, 7, 8 and 9). When parallel sunlight beams A, B and C pass through the transparent layer 11 and fall upon a slope 12M (see FIG. 9), the reflected beam a', b'and c' are reflected in various directions around the upper joint 14 because of the grooves 16 on the corrugated slope 12M. Accordingly, the afore-mentioned unevenness in sunlight reflection onto the skin on the side of the user not exposed, can be completely avoided. Thus an ideal—speedy and homogeneous—suntan can be achieved by the use of the suntanner of this invention.

While this invention has been described in terms of an embodiment, it is to be understood that the invention need not be limited to the disclosed embodiment. On the contrary, it is intended to cover various modifications included within the spirit and scope of the appended claims.

What is claimed is:

1. An inflatable suntanner comprising an upper transparent layer, a middle reflective layer and a bottom layer each of which is made of a flexible, gas impervious material, said middle layer being bonded to said upper layer at a plurality of upper joints to form an upper gas chamber between said upper layer and said middle layer, and bonded to said bottom layer at a plurality of lower joints to form a lower gas chamber between said middle layer and said bottom layer, characterized in that:

the size of each of said upper joints is different from that of each of said lower joints so as to corrugate those portions of said middle reflective layer interconnecting said upper and lower joints, whereby sunlight passing through said upper transparent layer and incident on said corrugated reflective layer can be irregularly reflected upon the side of the user not exposed to the sun rays so as to expedite a homogeneous suntan.

2. An inflatable suntanner as described in claim 1, wherein said lower joint is larger than said upper joint.

3. An inflatable suntanner as described in claim 1, wherein said upper gas chamber communicates with said lower gas chamber.

4. An inflatable suntanner as described in claim 1, wherein said upper gas chamber does not communicate with said lower gas chamber.

5. An inflatable suntanning support mattress for achieving a substantially even distribution of light rays across the unexposed surface of a body comprising:

a first upper transparent layer, a second middle reflective layer and a third bottom layer, each of said layers being made of a flexible, gas impervious material;

a plurality of upper joints bonding said first upper layer to said second middle layer to form an upper gas chamber between said upper layer and said middle layer;

a plurality of lower joints bonding said third bottom layer to said second middle layer to form a lower gas chamber between siad middle layer and said bottom layer, the size of each of said upper joints being different from that of each of said lower joints so as to form a corrugated surface on the portions of said second middle layer between said upper and lower joints, said corrugated surface thereby randomly reflecting light rays incident thereon in a plurality of directions to impinge against the unexposed surface of a body for achieving a substantially even distribution of light rays across said unexposed surface of body.

* * * * *